United States Patent [19]

Schulz et al.

[11] Patent Number: 4,966,576

[45] Date of Patent: Oct. 30, 1990

[54] CONTINUOUSLY OPERATING CENTRIFUGE DRUM

[75] Inventors: Dieter Schulz, Oelde; Ulrich Wrede, Ennigerloh-Ostenfelde; Wilfried Mackel, Oelde, all of Fed. Rep. of Germany

[73] Assignee: Westfalia Separator AG, Oelde, Fed. Rep. of Germany

[21] Appl. No.: 415,393

[22] Filed: Sep. 29, 1989

Related U.S. Application Data

[63] Continuation of Ser. No. 51,975, May 18, 1987, abandoned.

[30] Foreign Application Priority Data

Jun. 7, 1986 [DE] Fed. Rep. of Germany ..... 3619298

[51] Int. Cl.[5] ..... B04B 11/00

[52] U.S. Cl. ..... 494/56; 494/68; 494/70

[58] Field of Search ..... 494/2, 3, 40, 43, 56, 494/57, 59, 60, 65, 67, 68, 70, 35, 69, 74, 75, 79

[56] References Cited

U.S. PATENT DOCUMENTS

| | | | |
|---|---|---|---|
| 463,058 | 11/1881 | Laidlaw | 494/43 |
| 1,749,291 | 3/1930 | Lindgren | 494/56 |
| 2,068,520 | 1/1937 | Strezynski | 494/56 |
| 2,286,355 | 6/1942 | Fitzsimmons | 494/70 |
| 2,435,623 | 2/1948 | Forsberg | 494/56 |
| 2,598,118 | 5/1952 | Garmiche | 494/57 |
| 2,695,748 | 11/1954 | Millard | 494/56 |
| 3,404,000 | 10/1968 | Nilson | 494/3 |
| 3,623,657 | 11/1971 | Trump | 494/57 |
| 3,990,632 | 11/1976 | Hemfort | 494/2 |
| 4,278,200 | 7/1981 | Gunnewig | 494/65 |
| 4,311,270 | 1/1982 | Hovstadius | 494/2 |
| 4,397,638 | 8/1983 | Wilson | 494/40 |
| 4,509,942 | 4/1985 | Gunnewig | 494/56 |

FOREIGN PATENT DOCUMENTS

| | | | |
|---|---|---|---|
| 920360 | 11/1954 | Fed. Rep. of Germany | 494/70 |
| 1008660 | 5/1957 | Fed. Rep. of Germany . | |

*Primary Examiner*—Philip R. Coe
*Assistant Examiner*—Stephen F. Gerrity
*Attorney, Agent, or Firm*—Sprung Horn Kramer & Woods

[57] ABSTRACT

A continuously operating centrifuge drum for concentrating suspended solids. The solids that precipitate in a stack of disks accumulate in a solids space and are diverted into a receiving chamber through mouthpieces. The mouthpieces contain throttle bores and communicate with the periphery of the solids space. To improve the known centrifuge drum to the extent that an optimal solids concentration can be obtained at low expense with no detriment to the clarified phase, there are secondary mouthpieces that also contain throttle bores, that communicate with a radially inner zone of the solids space, and that another receiving chamber is associated with. Since the volume of solids that can be diverted through the primary mouthpieces is less than the volume of solids separated in the drum, the solids flow out of the primary mouthpieces at the maximum attainable concentration, whereas the excess solids flow out through the secondary mouthpieces.

9 Claims, 2 Drawing Sheets

CONTINUOUSLY OPERATING CENTRIFUGE DRUM

This application is a continuation of application Ser. No. 051,975, filed May 18, 1987, (now abandoned).

BACKGROUND OF THE INVENTION

The present invention relates to a continuously operating centrifuge drum for concentrating suspended solids, wherein the solids that precipitate in a stack of disks accumulate in a solids space and are diverted into a receiving chamber through mouthpieces that contain throttle bores and that communicate with the periphery of the solids space.

A centrifuge drum of this type is known from West German AS No. 1 008 660. The solids that precipitate in the stack of disks in this drum accumulate in the solids space and flow, due to the double cylindrical-conical design of the outer surface of the solids space, to the largest diameter or to the periphery thereof. From the periphery the solids are extracted through mouthpieces that communicate with it. This arrangement of mouthpieces is optimal for attaining a high concentration of solids. The cross-section of the throttle bores in the mouthpieces must of course either precisely match the volume of solids being diverted or be larger, and the concentration of solids is controlled by returning some of the diverted solids back into the solids space through special channels.

The aforesaid embodiment is the only one that makes sense to employ when the amount of entering solids fluctuates. Its engineering and controls-technology expense, however, is relatively high. Furthermore, to prevent the clarified phase of the liquid from becoming cloudy, it is impossible to work at the highest possible concentration of solids because it can no longer be ensured that all of the solids will be diverted out of the solids space.

SUMMARY OF THE INVENTION

The object of the present invention is to improve the known centrifuge drum to the extent that an optimal solids concentration can be obtained at low expense with no detriment to the clarified phase.

This object is attained in accordance with the invention by the improvement consisting of secondary mouthpieces that also contain throttle bores, that communicate with a radially inner zone of the solids space, and that are associated with another receiving chamber.

The function of the primary mouthpieces, which extend from the periphery of the centrifuge drum, is as before to divert the solids out at the highest possible concentration. If the capacity of the primary mouthpieces is exceeded due to an increased supply of solids, the excess solids can be diverted through the secondary mouthpieces, which extend from the radially inner zone of the solids space. The function of the secondary mouthpieces is accordingly to handle the solids overflow. If no excess solids are present, the phase leaving the secondary mouthpieces will be mainly liquid. Since, however, the primary and the secondary mouthpieces divert the solids into separate receiving chambers, the concentration of the solids diverted through the primary mouthpieces will not be affected.

Depending on the type of product being processed, the secondary mouthpieces can communicate with different regions of the solids space. Thus they can communicate with a central region of the solids space, with a lower region, or with an upper region.

Both the primary mouthpieces and the secondary mouthpieces can be positioned at the largest diameter of the drum, pointing radially inwardly toward the largest diameter of the drum, or at different points along the largest diameter of the drum. The particular position depends again on the type of product being processed.

At least one of the receiving chambers associated with the mouthpieces can rotate along with the drum, and the solids can be diverted out of one of the chambers by means of a skimmer. This system makes it possible to divert the solids under pressure.

A maximum concentration of solids can be obtained at the exit from the primary mouthpieces if the overall cross-section of the throttle bores in the primary mouthpieces is dimensioned to allow only some of the solids separated in the drum to be diverted through them. This system ensures a constant excess of solids at the periphery of the drum, and the solid particles that accumulate near the center of the drum cannot leave the solids space until they arrive at the point where they are extracted through the secondary mouthpieces.

The clarified phase can be reliably prevented from clouding up if the overall cross-section of the throttle bores in the primary and secondary mouthpieces is larger than necessary for diverting the solids centrifuged out in the drum.

Some preferred embodiments of the invention will now be specified with reference to the attached drawings, wherein

DETAILED DESCRIPTION THE PREFERRED EMBODIMENTS

Figure 1:
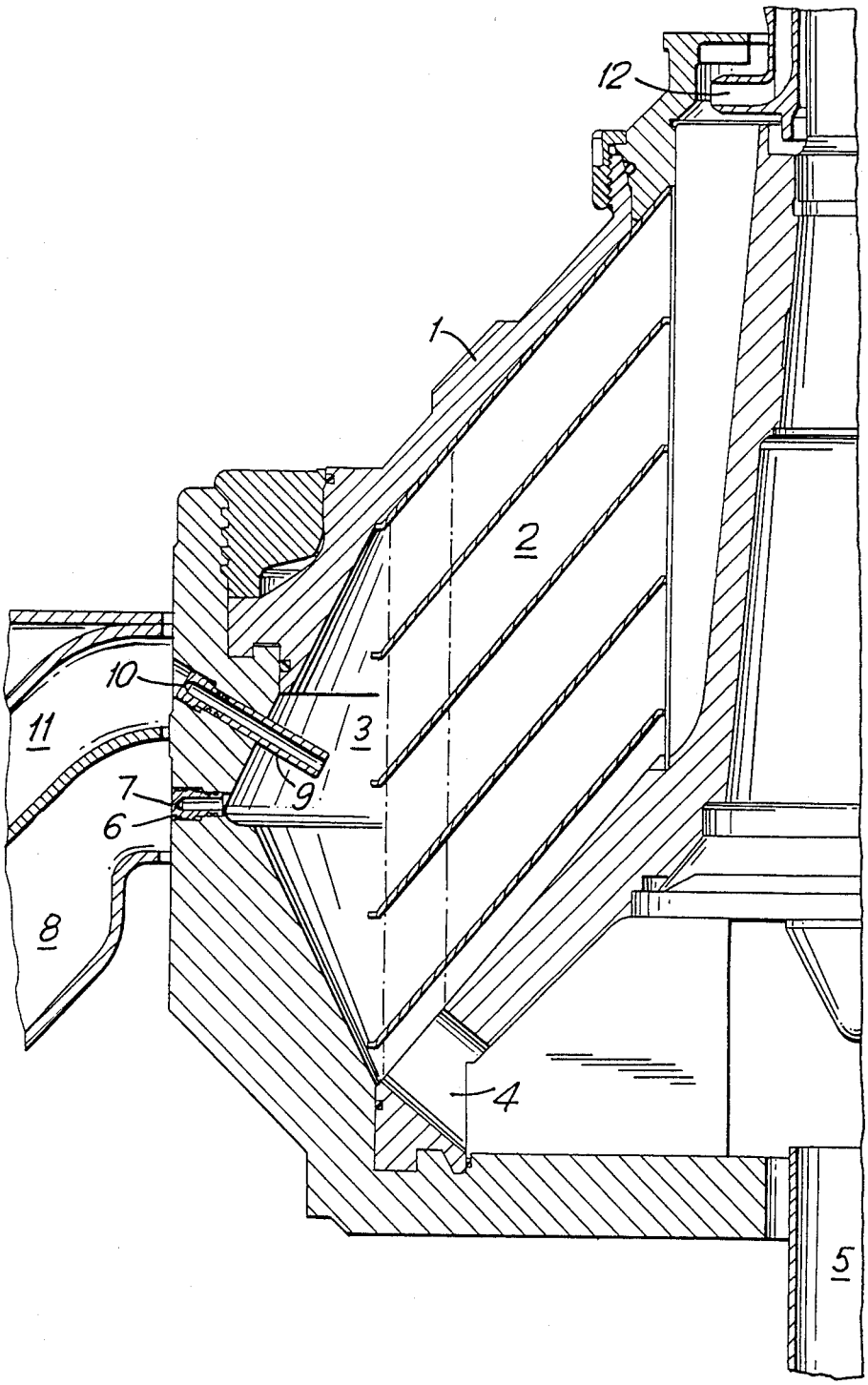
FIG. 1 illustrates a centrifuge drum according to the invention from which the solid phases emerge into stationary receiving chambers and FIG. 2 illustrates a centrifuge drum according to the invention with its primary mouthpieces positioned in a rotating primary receiving chamber.

A stack of disks 2 is concentrically surrounded by a solids space 3 in the centrifuge drum 1 illustrated in FIG. 1. Disks 2 communicate with an infeed 5 through channels 4. Mouthpieces 6 that are provided with throttle bores 7 and that are associated with a receiving chamber 8, extend from the periphery of solids space 3. Other mouthpieces 9 that are provided with throttle bores 10 and that are associated with another receiving chamber 11, communicate with a radially inner zone of solids space 3. The clarified liquid is diverted out of drum 1 by means of a skimmer 12.

A suspension of solids is supplied to drum 1 through infeed 5 and enters the stack of disks 2 through channels 4. The separated solids slide down through solids space 3 and are extracted from its periphery and introduced into primary receiving chamber 8 through primary mouthpieces 6. Another stream of the product is extracted from a radially inner zone in solids space 3 through secondary mouthpieces 9 and is conveyed into secondary receiving chamber 11. If the volume of solids arriving in the drum is larger than the volume that can be diverted through primary mouthpieces 6, the excess solids will flow out through secondary mouthpieces 9. Due to the excess solids at the periphery of solids space 3, the maximum possible concentration of solids will be deflected to primary mouthpieces 6. This phase of the product is forwarded for further processing. The product phase flowing out through secondary mouthpieces 9 contains only a relatively low percentage of solids. It is accordingly returned to a conventionally available product-feed tank. To keep the volume of solids returned to the product-feed tank low the solids can be supplied to the drum in accordance with the level of solids in the product phase leaving the secondary mouthpieces.

Figure 2:
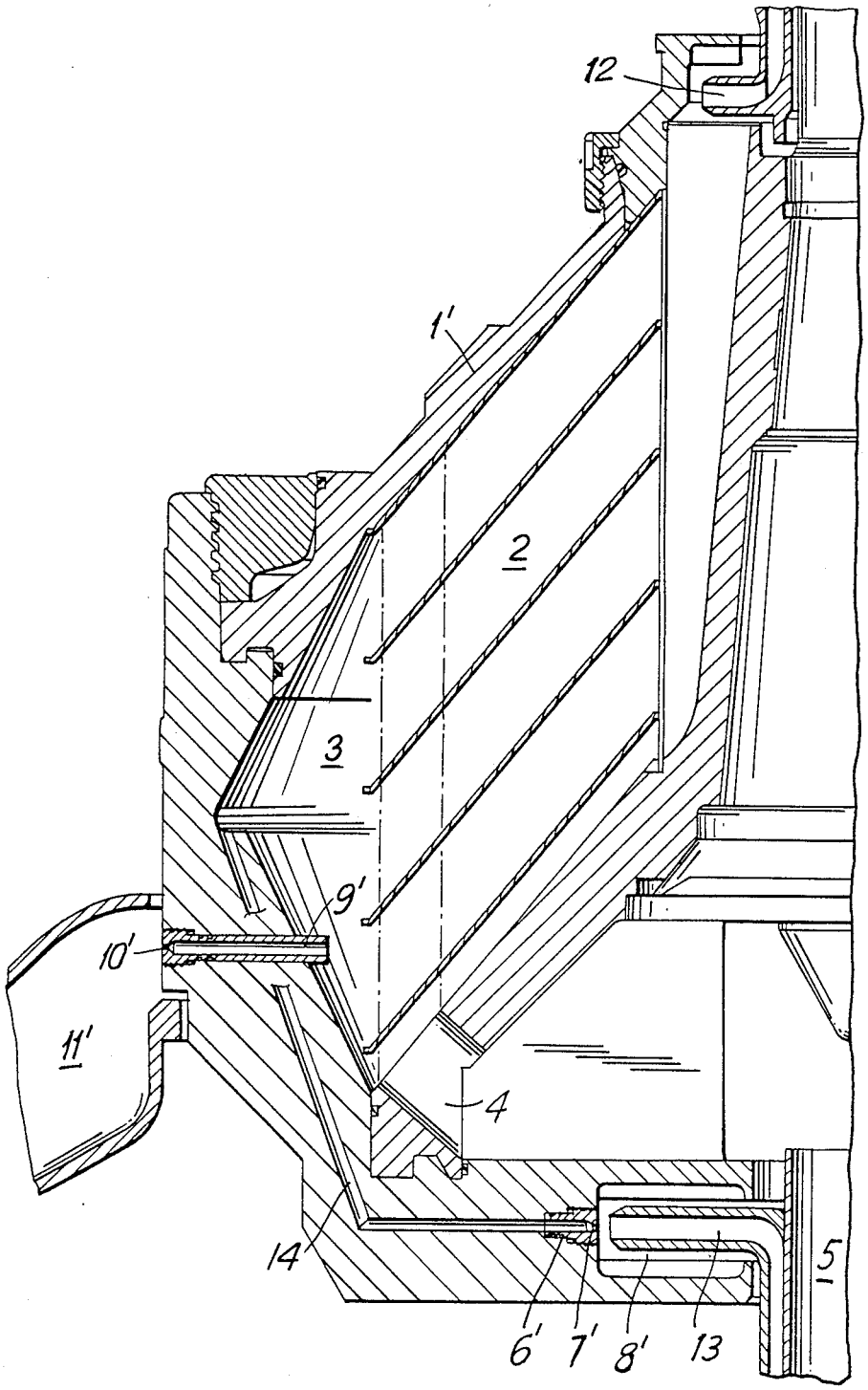

In the embodiment shown in FIG. 2, a suspension of solids is supplied to drum 1' through infeed 5 and enters the stack of disks through channels 4. In this embodiment the primary mouthpieces 6' having throttle bores 7' lead to a rotating receiving chamber 8' and thus have passages 14 leading thereto with their inflow openings at the largest internal diameter of the drum in solid space 3. In order to discharge the solids flowing out through the mouthpieces 6', the drum accommodates another skimmer 13 in receiving chamber 8'.

The secondary mouthpieces 9' have throttle bores 10' and open into receiving chamber 11'.

In the embodiment of FIG. 1, the secondary mouthpieces 9 communicate with an intermediate zone in the solids space 3, whereas in the embodiment of FIG. 2, the secondary mouthpieces 9' communicate with a lower zone of solids space 3. The secondary mouth pieces 9' in FIG. 2 can be disposed in an upper zone of solid space 3 if desired.

As shown in FIGS. 1 and 2, the inflow for the primary mouth pieces 6 and 6' are disposed along the largest diameter of the drum at the outermost point thereof. The secondary mouthpiece 9 as shown in FIG. 1 preferably points inwardly towards the largest diameter. Thus as shown in FIG. 1 the inflow for the two mouthpieces 6, 9 are approximately along the longest diameter. As shown in FIG. 2, the primary mouthpiece and secondary mouthpiece are set in regions of different diameters of the drum.

It will be appreciated that the instant specification and claims are set forth by way of illustration and not limitation, and that various modifications and changes may be made without departing from the spirit and scope of the present invention.

What is claimed is:

1. In a continuously operating centrifuge drum for concentrating suspended solids, having a first skimmer for directing clarified liquid from the drum and wherein the solids precipitate in a stack of disks and accumulate in a solids space and are diverted into a first receiving chamber through continuously dischargeable primary mouthpieces that contain throttle bores that communicate with an outer periphery of the solids space, the improvement comprising continuously dischargeable secondary mouthpieces including throttle bores that communicate with a radially inner zone of the solids space relative to the primary mouthpieces to discharge solids overflow which cannot be discharged by the primary mouthpieces, and a second receiving chamber disposed outside the solids space and receptive of solids diverted by the secondary mouthpieces, wherein the throttle bores in the primary mouthpieces have an overall cross section which is dimensioned to allow only a portion of the solids separated in the drum to be diverted therethrough, whereby a solid stream with a relatively high solid concentration is received in the first receiving chamber and a solid stream with a relatively low solid concentration is received in the second receiving chamber.

2. The drum as in claim 1, wherein the secondary mouthpieces communicate with a central region of the solids space.

3. The drum as in claim 1, wherein the secondary mouthpieces communicate with a lower region of the solids space.

4. The drum as in claim 1, wherein the secondary mouthpieces communicate with an upper region of the solids space.

5. The drum as in claim 1, wherein the drum has a largest diameter portion and the primary mouthpieces and the secondary mouthpieces open along the largest diameter portion of the drum.

6. The drum as in claim 1, wherein the drum has a largest diameter portion the primary mouthpieces and the secondary mouthpieces point inwardly toward the largest diameter portion of the drum.

7. The drum as in claim 1, wherein the primary mouthpieces and the secondary mouthpieces are disposed in a region of varying diameter of the drum.

8. The drum as in claim 1, wherein the first receiving chamber associated with the primary mouthpieces rotates along with the drum, and the solids are diverted out of said first chamber by a second skimmer.

9. The drum as in claim 1, wherein the throttle bores in the primary and secondary mouthpieces have an overall cross-section which is larger than necessary for diverting the solids centrifuged out of the drum.

* * * * *